United States Patent [19]

Rex

[11] 4,401,323

[45] Aug. 30, 1983

[54] HOLDER FOR CREDIT CARD PURCHASE FORM

[75] Inventor: Roger F. Rex, Hales Corners, Wis.

[73] Assignee: DCI Marketing, Milwaukee, Wis.

[21] Appl. No.: 271,040

[22] Filed: Jun. 5, 1981

[51] Int. Cl.[3] ..... B42F 9/00

[52] U.S. Cl. ..... 281/45; 24/67.11; 402/69

[58] Field of Search ..... 281/45, 49, 15 B; 402/69; 24/67.11, 67.3, 67.5, 67.7, 67.9; 40/13

[56] References Cited

U.S. PATENT DOCUMENTS

| | | | |
|---|---|---|---|
| 2,051,551 | 8/1936 | Evans | 281/45 X |
| 3,423,798 | 1/1969 | O'Donnell | 24/67.11 X |
| 3,638,282 | 2/1972 | Larsson | 24/67.3 |
| 3,670,370 | 6/1972 | Goodwin | 281/45 |
| 3,711,899 | 1/1973 | Shelton et al. | 24/67.7 |
| 3,740,877 | 6/1973 | Hunt | 40/13 |
| 3,833,970 | 9/1974 | Smith, Jr. | 24/67.5 |
| 3,848,547 | 11/1974 | Schaefer | 281/45 X |
| 3,968,546 | 7/1976 | Seaborn et al. | 24/67.11 X |
| 4,014,077 | 3/1977 | Hitchcock | 24/67.5 |
| 4,110,872 | 9/1978 | Gould | 24/67.11 |

*Primary Examiner*—Gil Weidenfeld
*Assistant Examiner*—John S. Brown

[57] ABSTRACT

A device for holding a credit card purchase form is shown and includes a generally planar base having a flat surface portion over which the form extends. A clamp member is provided, the clamp member having one edge adapted to engage the edge of the form and to force it against the base member. The clamp member pivots on its other edge. A pair of spaced apertures are formed in the planar base and a pair of hinge members project from the pivot edge of the clamp member and extend through the spaced apertures and provide a hinge arrangement for the clamp member. A lever member is fixedly joined to the pivot edge of the clamp member, and the lever member includes an end movable toward the planar base to cause pivotal movement of the clamp member and movement of the clamping edge away from the base. A compression spring is provided for biasing the lever member away from the base and for thereby biasing the clamping edge into clamping engagement with the base member, one of the ends of the spring engaging the lever member and an opposite end being supported by the base.

4 Claims, 4 Drawing Figures

HOLDER FOR CREDIT CARD PURCHASE FORM

FIELD OF THE INVENTION

The invention relates to apparatus such as clip boards and to holders for credit card purchase forms, these holders being intended to support the form while it is written on.

BACKGROUND PRIOR ART

Service stations and similar retailers and merchandizers commonly use some means, such as a clip board, for holding a credit card purchase form on which the customer's purchase is written. The clip board holds the form in place and provides a writing surface for supporting the form so that the customers can conveniently sign the form. An example of an improved prior art holder is illustrated in the Hunt, U.S. Pat. No. 3,740,877, issued June 26, 1973 and assigned to the assignee of the present invention.

Attention is also directed to the Rosenthal, U.S. Pat. No. 3,030,922, issued Apr. 24, 1962 and British Pat. No. 282,698.

SUMMARY OF THE INVENTION

The present invention provides a holder for a credit card purchase form and the like and which is an improvement over the device shown in the Hunt, U.S. Pat. No. 3,740,877.

The primary purpose of the invention is to provide a simple, durable and inexpensive device for holding both a credit card purchase form and a credit card. The invention also provides a holder having a size and shape which is easy to handle and which permits the purchaser to easily sign the purchase form. The invention also provides a clip mechanism which is strong and durable yet which is inexpensive to manufacture.

More particularly, the invention includes a device for holding a purchase form, the device having a flat surface portion over which the form extends, and means for clampingly engaging one edge of the form against the flat surface. The means for clamping includes a clamp member having opposite edges, one of the edges being adapted to engage the edge of the form and to force it against the base member. Means are also provided for pivotally connecting the other of the edges of the clamp member to the planar base whereby the other of the edges of the clamp member will engage the base member and the clamp member will pivot on that edge. The means for pivotally connecting includes a pair of spaced apertures formed in the planar base and a pair of hinge members projecting from the pivot edge of the clamp member and extending through the spaced apertures. A lever member is fixedly joined to the pivot edge of the clamp member and has an end movable toward the planar base to cause pivotal movement of the clamp member. Means are also provided for biasing the lever member away from the base and for biasing the clamping edge into clamping engagement with the base member, the means for biasing including a compression spring having opposite ends, one of the ends engaging the lever member and an opposite end supported by the base.

Various features of the invention are set forth in the following description, in the claims, and in the drawings.

Figure 1:
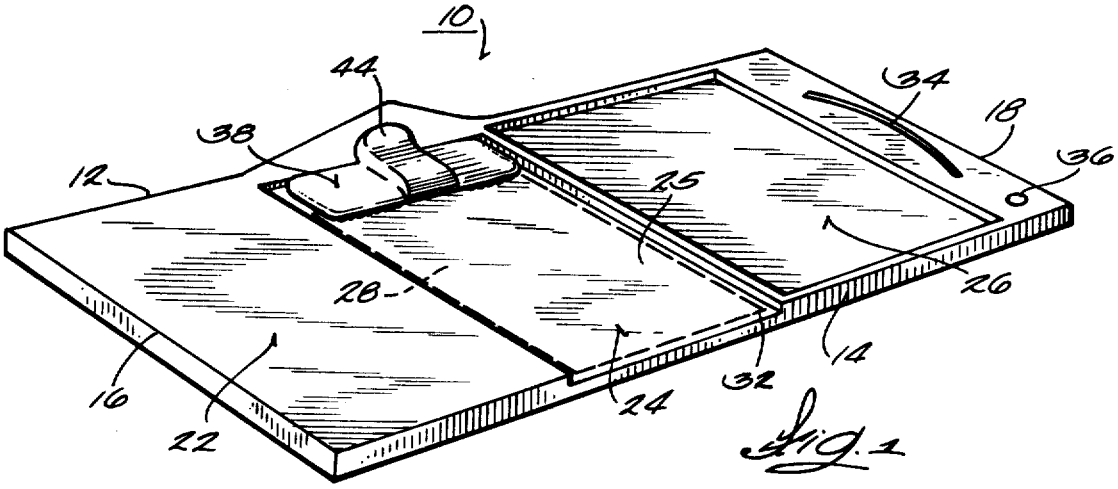
FIG. 1 is a perspective view of a purchase form holder embodying the invention.
Figure 2:
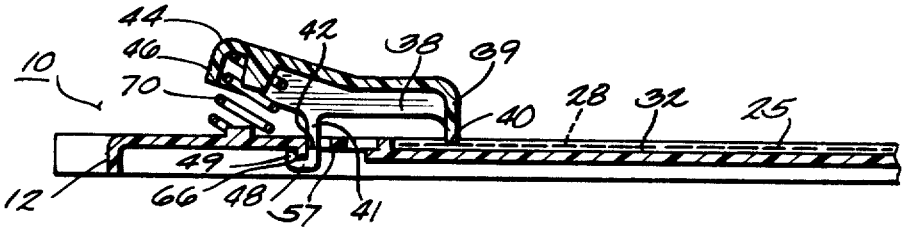
FIG. 2 is an enlarged cross section view taken along line 2—2 in FIG. 1.
Figure 3:
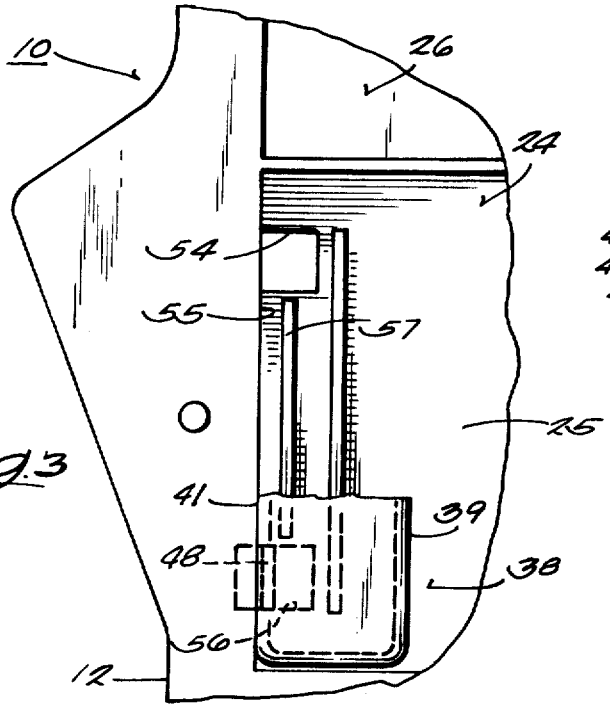
FIG. 3 is a partial plan view of the purchase form holder shown in FIGS. 1 and 2 and with portions broken away.
Figure 4:
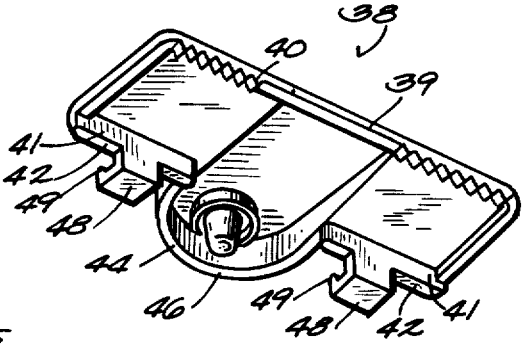
FIG. 4 is a bottom perspective view of the clamp member of the purchase form holder shown in FIG. 1.

Before describing a preferred embodiment of the invention in detail, it is to be understood that the invention is not limited in its application to the details of construction or to the arrangement of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

DESCRIPTION OF THE PREFERRED EMBODIMENT

The holder of the invention comprises a generally elongated rectangular base member 10 having sides 12 and 14 and ends 16 and 18. The base member 10 is also divided into 3 generally rectangular areas 22, 24 and 26. These areas include a central area 24 having a flat rectangular recess 25 open at the side 14 and arranged to receive a credit card purchase form 28 shown in FIG. 1 in phantom. Form 28 is a conventional credit card purchase form including a top sheet and an underlying sheet with an interposed sheet of carbon paper. Recess 25 has a smooth flat top surface 32 which provides a writing surface.

The rectangular area 26 of the base member comprises a recessed, lateral extension on which point-of-purchase advertising or the like can be mounted. Means are also provided there for holding the customer's credit card and for holding a pen. The means for holding the credit card comprises an arcuate slot 34 formed in the end of the rectangular area 26. An aperture 36 is also provided for holding a pen.

The rectangular portion 24 of the holder also supports means for clampingly engaging the edge of the credit card purchase form 28. This means includes a generally rectangular clamp member 38. The clamp member 38 is generally hollow and includes a forward downwardly extending wall 39 having an edge 40 adapted to engage the credit card form 28 to press it against the flat surface 32. The clamp member also includes a rearward downwardly extending wall 41 having a lower edge 42, and the clamp member 38 is adapted to pivot about the longitudinal edge 42 on the upper surface 32. A lever member 44 is fixedly joined to the clamp member 38 in such a manner that when the free end of the lever member 44 is forced toward the base 10, the longitudinal edge 40 of the clamp member 38 will move away from the base and release the credit card form 28.

Means are also provided for pivotally connecting the clamp member 38 to the base 10, this means including a pair of projections 48 acting as hinge members extending downwardly and rearwardly from the edge 42 of the clamp member 38, these projections 48 extending through spaced rectangular apertures 54 and 56 in the central area 24. More particularly, the base 10 includes a rib 66 extending along a lower edge of each of the apertures 54 and 56. The projections 48 are intended to extend through the apertures 54 and 56 and each include rearward upwardly bent end portions 49 which are somewhat flexible and can be snapped over the ribs 66 whereby the projections 48 and 50 are prevented from being pulled out of the apertures 54 and 56. Thus, the pivot edge 42 of the clamp member is held against the planar surface 32, but the clamp member 38 is freely pivotable. Movement of the end portions 49 of projections 48 and 50 away from the ribs 66 is also prevented because the lower edge 42 of wall 41 is housed between a shoulder 55 of the recess 25 and an elongated narrow rib 57 extending upwardly from surface 32 and being parallel to shoulder 55.

Means are further provided for biasing the clamp member 38 toward a position wherein the edge 40 will firmly clampingly engage the credit card form 28. The biasing means includes a compression spring or coil spring 70 compressed between the free end 46 of the lever 44 and the base such that movement of the free end 46 of the lever is resisted by the spring 70.

Various features and advantages of the invention are set forth in the following claims.

I claim:

1. A device for holding a purchase form, the device comprising:

a generally planar base having a flat surface portion over which said form extends, means for clamping one edge of said form against said surface, said means for clamping including:

a rigid clamp member including opposite edges, one of said edges being adapted to engage the edge of the form and to force it against said base member, means for pivotally connecting the other of said edges of said clamp member to said planar base whereby said other of said edges of said clamp member will engage said base member and said clamp member will pivot on said other of said edges, said means for pivotally connecting including means defining a pair of spaced apertures formed in said planar base and a pair of projections acting as hinge members extending downwardly from said other of said edges of said clamp member and extending through said spaced apertures, said projections including means for engaging an edge of said apertures and for preventing removal of said projections from said apertures, a lever member fixedly joined to said other of said edges of said clamp member, said lever member including an end being movable toward the planar base to cause pivotal movement of said clamp member and movement of said one edge away from said base, and means for biasing said lever member away from said base and for thereby biasing said one edge into clamping engagement with said base member, said means for biasing including a compression spring having opposite ends, one of said ends engaging said lever member, and an opposite end being supported by said base.

2. A device as set forth in claim 1 wherein said compression spring is a coil spring compressed between said lever member and said base.

3. A device as set forth in claim 1 wherein said planar base includes a pair of generally planar members on opposite sides of said flat surface member and being generally coplanar with said flat surface member.

4. A device as set forth in claim 1 wherein said one of said planar members includes means for holding a credit card, said means for holding including a slot in the upper surface of planar member.

* * * * *